US008150092B2

(12) United States Patent
Huang et al.

(10) Patent No.: US 8,150,092 B2
(45) Date of Patent: Apr. 3, 2012

(54) SPEAKER MODULE OF ELECTRONIC DEVICE

(75) Inventors: Ming-Shuo Huang, Taipei (TW); Chi-Cheng Liao, Taipei (TW); Cheng-Yu Lin, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 534 days.

(21) Appl. No.: 12/427,950

(22) Filed: Apr. 22, 2009

(65) Prior Publication Data

US 2010/0020999 A1 Jan. 28, 2010

(30) Foreign Application Priority Data

Jul. 23, 2008 (TW) ..... 97128018 A

(51) Int. Cl.
*H04R 1/02* (2006.01)

(52) U.S. Cl. ..... 381/386; 348/375; 396/535; 600/101; 600/102; 600/109; 600/131; 600/167

(58) Field of Classification Search ..... 381/386, 381/387; 348/375; 396/535; 600/101, 102, 600/109, 131, 167

See application file for complete search history.

*Primary Examiner* — Jarrett Stark
*Assistant Examiner* — Lawrence Tynes, Jr.
(74) *Attorney, Agent, or Firm* — Muncy, Geissler, Olds & Lowe, PLLC

(57) ABSTRACT

An acoustic speaker module of a portable electronic device includes an acoustic housing, an acoustic speaker, a chip card and an elastic member. The acoustic housing has an accommodation space, a first opening and a second opening. The acoustic speaker is seamlessly connected with the first opening. The chip card is disposed at the second opening. The elastic member and the chip card are disposed at the second opening to make the accommodation space to form a hermetical space.

8 Claims, 4 Drawing Sheets

SPEAKER MODULE OF ELECTRONIC DEVICE

RELATED APPLICATIONS

This application claims priority to Taiwan Application Serial Number 97128018, filed Jul. 23, 2008, which are herein incorporated by reference.

BACKGROUND

1. Field of Invention

The present invention relates to an acoustic speaker module. More particularly, the present invention relates to an acoustic speaker module of a portable electronic device.

2. Description of Related Art

An acoustic housing's size or volume of an acoustic speaker module may affect the acoustic performance. In a usual case, the more the acoustic housing's volume, the better the acoustic performance is. However, a conventional portable electronic device always suffers from insufficient acoustic housing's volume. For a small-size electronic device (such as a mobile phone), insufficient acoustic housing's volume would result in a poor acoustic performance. For the forgoing reasons, there is a need for increasing the acoustic housing's volume of the acoustic speaker module.

SUMMARY

It is therefore an objective of the present invention to provide an acoustic speaker module of a portable electronic device.

In accordance with the foregoing and other objectives of the present invention, an acoustic speaker module of a portable electronic device includes an acoustic housing, an acoustic speaker, a chip card and an elastic member. The acoustic housing has an accommodation space, a first opening and a second opening. The acoustic speaker is seamlessly connected with the first opening. The chip card is disposed at the second opening. The elastic member and the chip card are disposed at the second opening to make the accommodation space to form a hermetical space.

Thus, the present invention provides an acoustic speaker module, which integrates a chip card reader module to expand the acoustic housing's size and improves the acoustic housing's sealing to be airtight, such that the acoustic 10 speaker module can have a better acoustic performance.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
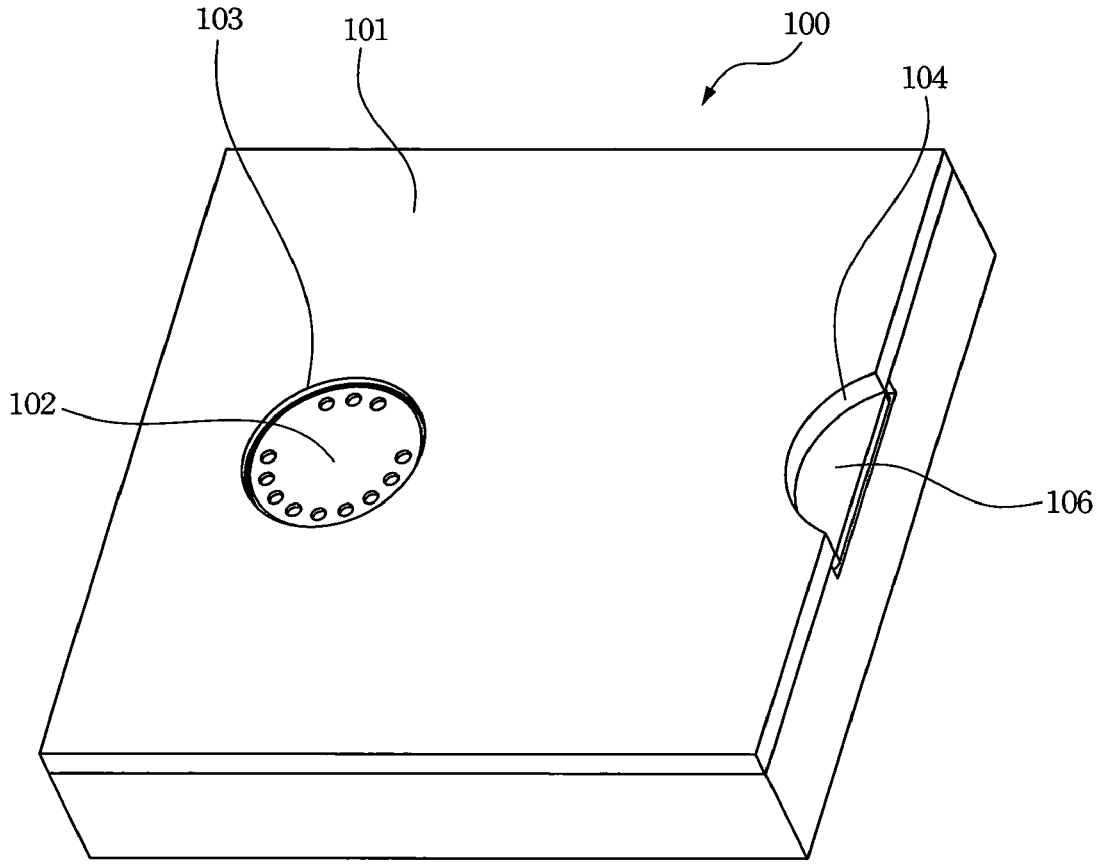
FIG. 1 illustrates an acoustic speaker module according to one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
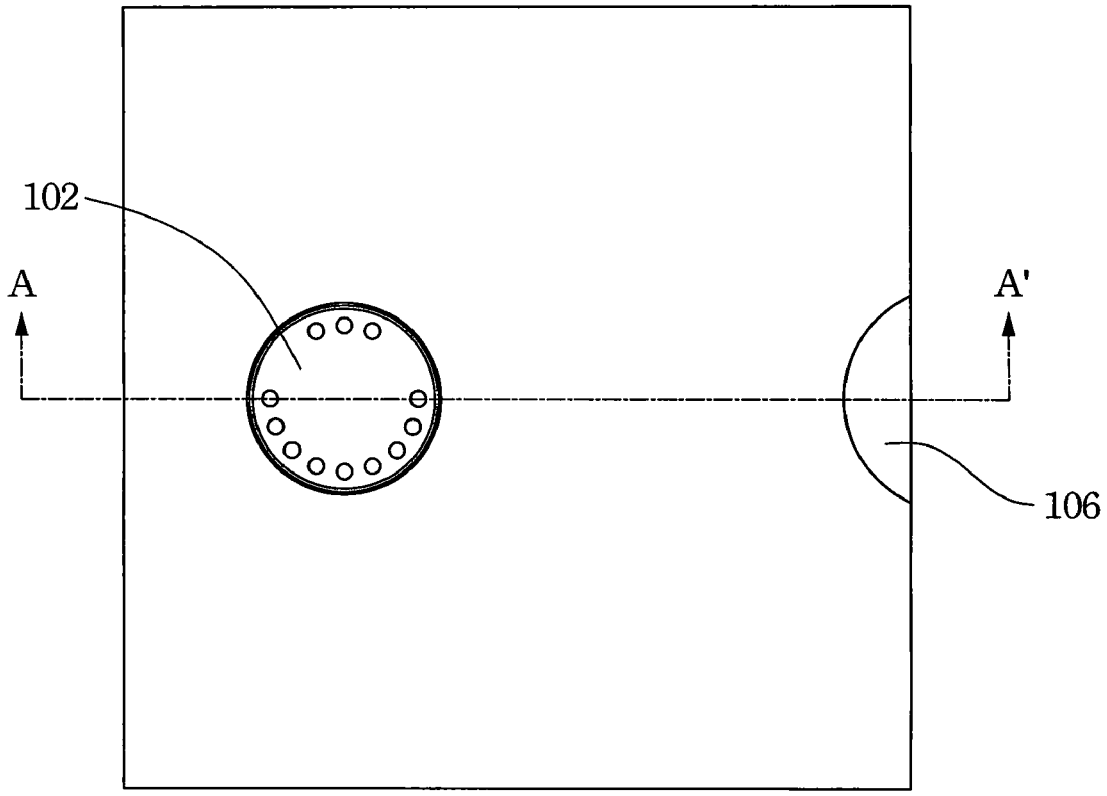
FIG. 2 illustrates a top view of the acoustic speaker module as illustrated in FIG. 1.

FIG. 1 illustrates an acoustic speaker module according to one preferred embodiment of this invention. FIG. 2 illustrates a top view of the acoustic speaker module as illustrated in FIG. 1. The acoustic speaker module 100 includes an acoustic housing 101 and an acoustic speaker 102, and further includes a chip card reader module to expand the acoustic housing's size. Thus, the space layout within an electronic device to form an acoustic housing can be more flexible. To integrate the chip card reader module as part of the acoustic speaker module, the chip card reader module needs to be airtight seamless or hermetical. The acoustic housing 101 includes an opening 103 for the acoustic speaker 102 to be seamlessly connected with. Another opening 104 allows a chip card 106 to be inserted. A solution for seamlessly sealing the opening 104 is described below.

Figure 3:
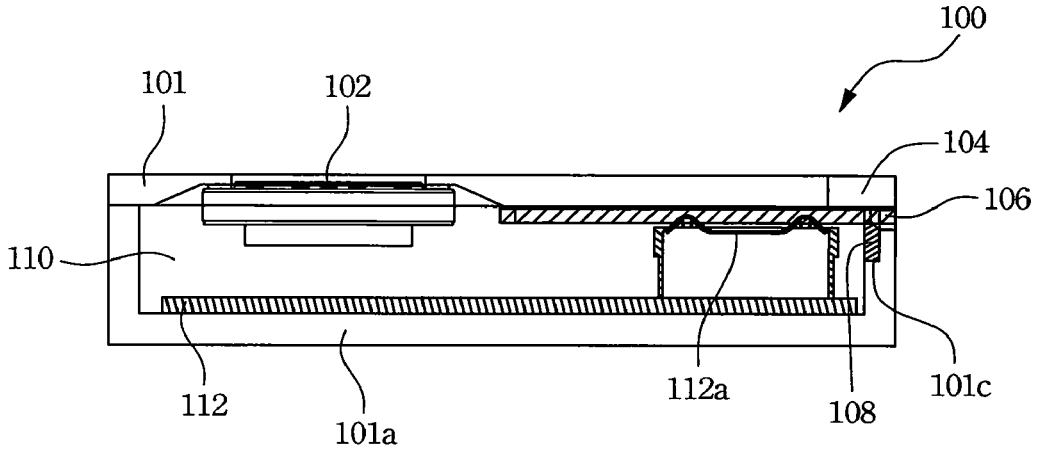
FIG. 3 illustrates a cross-sectional view taken along A-A' in FIG. 2.

FIG. 3 illustrates a cross-sectional view taken along A-A' in FIG. 2. The acoustic speaker module 100 includes an accommodation space 110 (a single one, not divided into multiple partitions) within the acoustic housing 101. The accommodation space 110 needs to be airtight sealed or hermetical. When the chip card 106 is inserted at the opening 104, the opening 104 is not sealed airtight such that the acoustic performance, e.g. low-frequency performance, would be inversely affected. In order to generate an airtight sealing after inserting the chip card 106 into the opening 104, an elastic member 108 is attached to a concave section 101*c* on an inner wall of the acoustic housing 101. In addition, the chip card reader module may include related structures inside the acoustic housing 101, e.g. a printed circuit board 112 and a connector 112*a*. The acoustic housing 101 has a bottom wall 101*a*, on which the printed circuit board 112 is located. The connector 112*a* is located on the printed circuit board 112 to be electrically connected with the chip card 106. In this embodiment, the chip card 106 can be any pocket-sized or even smaller card with embedded integrated circuits which can process data, such as a subscriber identity module card or a memory card.

Figure 4:
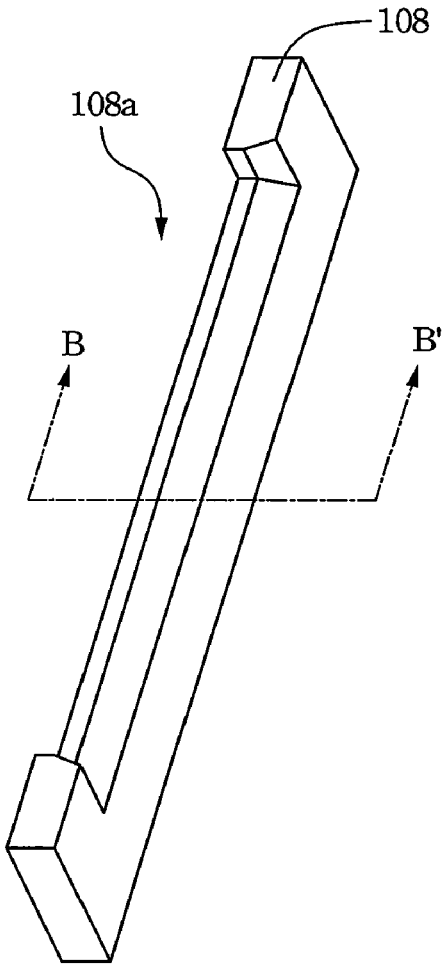
FIG. 4 illustrates an elastic member as illustrated in FIG. 3.
Figure 5:
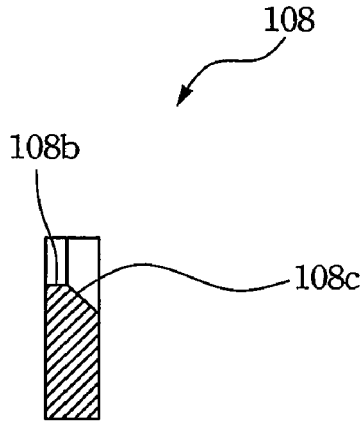
FIG. 5 illustrates a cross-sectional view taken along B-B' in FIG. 4.

FIG. 4 illustrates an elastic member as illustrated in FIG. 3. FIG. 5 illustrates a cross-sectional view taken along B-B' in FIG. 4. The elastic member 108 is a U-shaped member or a member with a rectangular indentation. When the elastic member 108 is assembled within the acoustic housing 101, an indentation 108*a* is aligned with the opening 104 of the acoustic housing 101. The inner edge 108*b* of the indentation 108*a* is in contact with the chip card 106 (after the chip card 106 is inserted into the opening 104). The elastic member 108 can be made from a rubber or a sponge, and the inner edge 108*b* of the indentation 108*a* can be airtight in contact with the chip card 106 so as to avoid an air-leaking gap between the opening 104 and the chip card 106. Therefore, the accommodation space 110 within the acoustic housing 101 can be airtight sealed or hermetical. The indentation 108*a* further includes an inclined surface 108*c* at an inner periphery thereof allowing the chip card 106 to be readily inserted.

Figure 6:
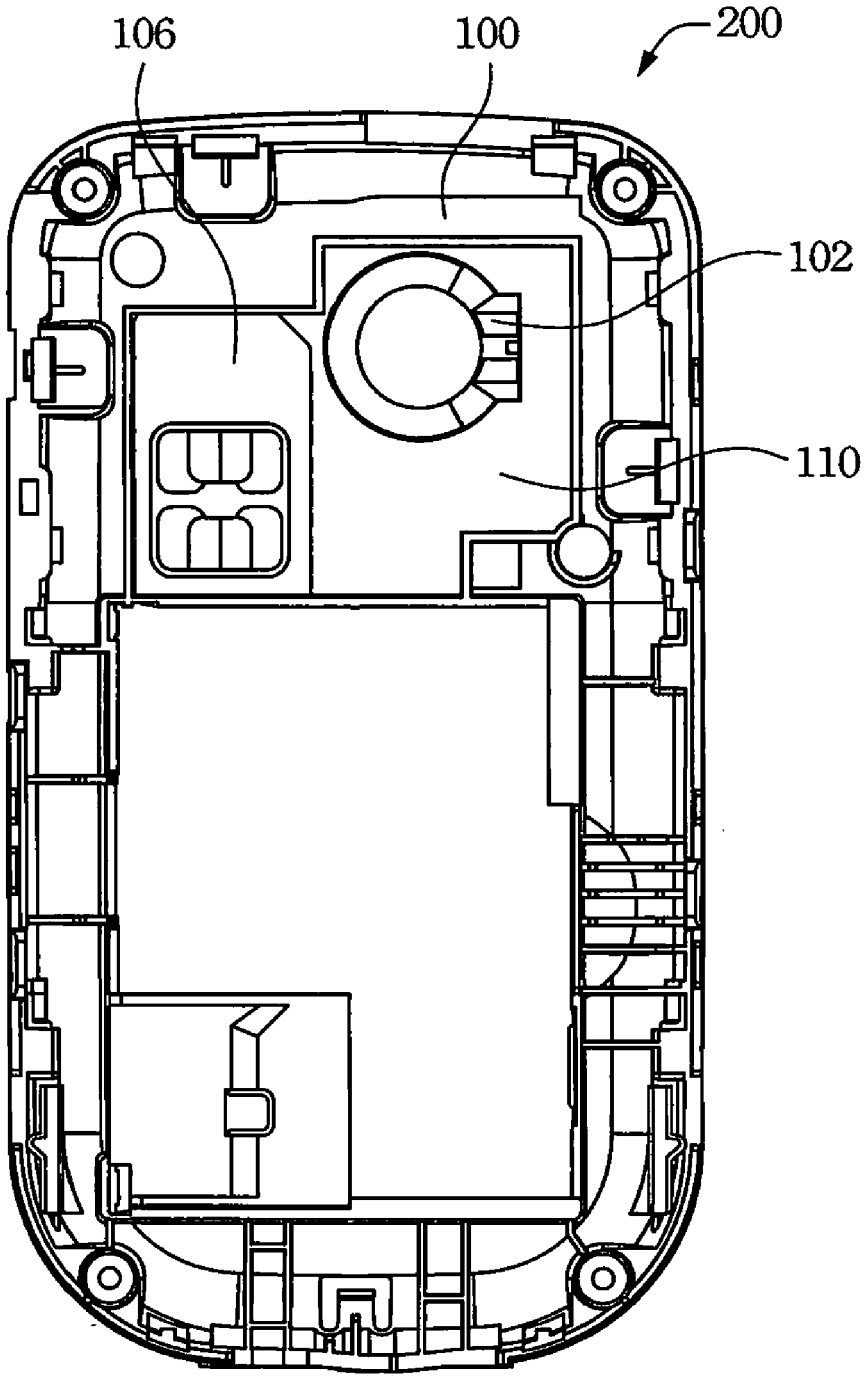
FIG. 6 illustrates an electronic device, in which the acoustic speaker module is installed, according to one preferred embodiment of this invention.

FIG. 6 illustrates an electronic device, in which the acoustic speaker module is installed, according to one preferred embodiment of this invention. The electronic device 200 is illustrated with a bottom wall 101*a* and a connector 112*a* removed (referring also to FIG. 3). When the acoustic speaker module 100 is adapted into the portable electronic device 200, the acoustic speaker module 100 integrates the chip card reader module to expand the acoustic housing's size. Thus, the space layout within an electronic device to form an acoustic housing can be more flexible. The acoustic speaker module 100 is preferably applied to a small-size portable electronic device, such as a mobile phone, a palm-size computer, a smart phone or a personal digital assistant.

According to above-discussed embodiments, the present invention provides an acoustic speaker module, which integrates a chip card reader module to expand its acoustic housing's size and improves its acoustic housing's sealing to be airtight, such that the acoustic speaker module can have a better acoustic performance.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An acoustic speaker module of a portable electronic device, comprising:

an acoustic housing having an accommodation space, a first opening and a second opening;

an acoustic speaker seamlessly connected with the first opening;

a chip card disposed at the second opening; and an elastic member and the chip card disposed at the second opening to make the accommodation space to form a hermetical space.

2. The acoustic speaker module of claim 1, further comprising a printed circuit board on an inner wall of the acoustic housing.

3. The acoustic speaker module of claim 2, wherein the printed circuit board is electrically connected to the chip card.

4. The acoustic speaker module of claim 1, wherein the chip card is a subscriber identity module card.

5. The acoustic speaker module of claim 1, wherein the chip card is a memory card.

6. The acoustic speaker module of claim 1, wherein the elastic member is a rubber.

7. The acoustic speaker module of claim 1, wherein the elastic member is a sponge.

8. The acoustic speaker module of claim 1, wherein the elastic member comprises an indentation, having an inclined surface at an inner periphery.

* * * * *